US005873152A

United States Patent [19]

Jourde et al.

[11] Patent Number: 5,873,152

[45] Date of Patent: Feb. 23, 1999

[54] ALTERNATING ACTUATION DEVICE AND NEEDLING MACHINE PROVIDED THEREWITH

[75] Inventors: Bernard Jourde, Elbeuf; Pierre Mouchard, Criquebeuf sur Seine; Didier LeBloas, Thuit Signol, all of France

[73] Assignee: Asselin, Elbeuf, France

[21] Appl. No.: 860,813

[22] PCT Filed: Jan. 12, 1996

[86] PCT No.: PCT/FR96/00053

§ 371 Date: Aug. 11, 1997

§ 102(e) Date: Aug. 11, 1997

[87] PCT Pub. No.: WO96/21764

PCT Pub. Date: Jul. 18, 1996

[30] Foreign Application Priority Data

Jan. 12, 1995 [FR] France ..... 95 00294

[51] Int. Cl.[6] ..... D04H 18/00

[52] U.S. Cl. ..... 28/107; 74/44; 74/606 R

[58] Field of Search ..... 28/107, 111, 113, 28/114, 115; 112/80.01, 80.4, 80.42, 80.45; 74/25, 44, 51, 61, 606 R, 608, 609

[56] References Cited

U.S. PATENT DOCUMENTS

| | | | |
|---|---|---|---|
| 3,368,256 | 2/1968 | Fehrer et al. | 28/107 |
| 3,798,717 | 3/1974 | Brochetti | 28/107 |
| 3,877,121 | 4/1975 | Obenaus | 28/115 |
| 3,889,326 | 6/1975 | Tyas | 28/115 |
| 4,384,393 | 5/1983 | Asselin | 28/107 |
| 5,153,970 | 10/1992 | Konig | 28/107 |

FOREIGN PATENT DOCUMENTS

| | | | |
|---|---|---|---|
| 1660778 | 9/1971 | Germany | 28/107 |
| 2111496 | 9/1971 | Germany | 28/107 |

*Primary Examiner*—C. D. Crowder
*Assistant Examiner*—Larry D. Worrell, Jr.
*Attorney, Agent, or Firm*—Greer, Burns & Crain, Ltd.

[57] ABSTRACT

The needling machine includes a support and a stripper defining a path for a lap. A needle board supported by sliding rods has a reciprocating motion between the represented maximum penetration position and the withdrawal position by means of two rod-eccentric devices, each having a rod hinged to the sliding rod. Each pair of rods is hinged to a crankshaft supported by bearings and carrying an equilibration device. The bearings are supported in a crankcase by partitions in a position situated axially between the eccentrics and the equilibration device. The crankshaft extends from the crankcase through simple sealing liners. An advantage of the present needling machine is that the crankcase is stiffened and crankshaft deformations are reduced to increase the striking rate.

30 Claims, 4 Drawing Sheets

ALTERNATING ACTUATION DEVICE AND NEEDLING MACHINE PROVIDED THEREWITH

BACKGROUND OF THE INVENTION

The present invention relates to an alternating actuation device for a needling machine.

The present invention also relates to such a needling machine provided therewith, used for mechanically consolidating a fibre fleece coming, for example, from a crosslapper.

The known needling machines comprise a support called a board on which needles are fixed. Alternating actuation devices, having rods and cranks, impart an alternating motion to the board in order that the needles traverse the fibre fleece at a rate which can vary between 1000 and 2000 strokes per minute during production.

Additional devices also make it possible to regulate the flow of fibres entering and leaving the machine with or without drawing and at speeds chosen according to the striking rate and the number of strokes per minute, equivalent to the number of alternating movements of the needles per minute.

DE-A-1 660 778 describes an actuation device in which a crankshaft supported by four bearings drives the needle board with an alternating motion by the intermediary of two connecting rods. A bearing is shown on each side of each connecting rod in a diagrammatic way and without any corresponding description.

DE-A-2 111 496 describes successive crankshafts disposed along an upper beam of the needling machine. Each crankshaft end is supported by a bearing. In another arrangement, the crankshafts, parallel instead of being aligned, are disposed transversely with respect to the beam. Considering the limited width of the beam, the bearings are brought towards the centre and are thus positioned between a central equilibration means and each actuating eccentric for actuating the connecting rods.

These known devices operate in free air and are lubricated with grease.

Actuation devices are also known which are mounted in a sealed crankcase and which are lubricated with oil. In this case the crankshaft, oriented in the direction of the width of the fleece to be needled, is supported in rotation by two bearings mounted in openings provided in two opposite end walls of the crankcase. Between the two bearings, the crankshaft comprises two eccentrics forming cranks, each one of them connected to an actuating connecting rod, and supports equilibration means of the inertia and/or counterweight type. The crankshaft emerges from the crankcase through each of the bearings in order to be connected to a driving source and/or to another coaxial crankshaft, belonging to another actuation device.

The known actuation devices are subjected to high alternating loads which generate dangerous vibrations and noise. The force necessary to make the needles penetrate into the fleece is high. This results in generous dimensioning of the moving parts of the alternating actuation devices. The result of this is that large inertial forces are added to the intermittent force of penetration and extraction of the needles, and that the reciprocating actuation devices are subjected to substantial mechanical stresses and deformations. Finally, it is necessary to limit the striking rate.

The purpose of the invention is to increase the striking rate permitted to needling machines and/or to reduce the harmful effects of the alternating loads at a given rate.

SUMMARY OF THE INVENTION

According to a first aspect of the invention, the needling machine actuation device comprising a crankcase in which at least one crankshaft is supported in rotation by at least two bearings, the crankshaft comprising two eccentrics with each of which is articulated one of the ends of a connecting rod intended to be connected at its other end, at least indirectly, to a needle board, equilibration means furthermore being attached to the crankshaft, is characterized in that the two bearings are supported inside the crankcase at a position situated axially between the two eccentrics, in that the equilibration means are situated axially between the two bearings, and in that each eccentric is situated between the respective one of the two bearings and a peripheral wall of the crankcase.

Thus, the distance between the two bearings is small, and this considerably reduces the deformation in flexion of the crankshaft.

Furthermore, the bearings are supported closer to each other inside the crankcase, which increases the rigidity of their mutual positioning, and consequently further reduces the deformations which the crankshaft can undergo. The bearing supports which, according to the invention, it is necessary to provide inside the crankcase, can be designed as internal reinforcements for the crankcase.

In particular, these supports can be produced in the form of internal walls or partitions which brace the outer walls of the crankcase.

Because of the invention, the deformations generated by the striking forces and the inertia in the actuation device are considerably lessened, the mechanical reliability is increased, the vibrations are small, and consequently the striking rate can be increased.

According to a second aspect of the invention, the needling machine for mechanically consolidating a fibre fleece, comprising:

- means of causing the fibre fleece to move in a plane of motion,
- a needle board support,
- actuation means for mechanically actuating the needle board support in a reciprocating manner in a transverse direction with respect to the plane of motion,
- is characterized in that the actuation means comprise at least one device according to the first aspect of the invention.

Other features and advantages of the invention will emerge from the following description, relating to non-limitative example embodiments.

DETAILED DESCRIPTION

Figure 1:
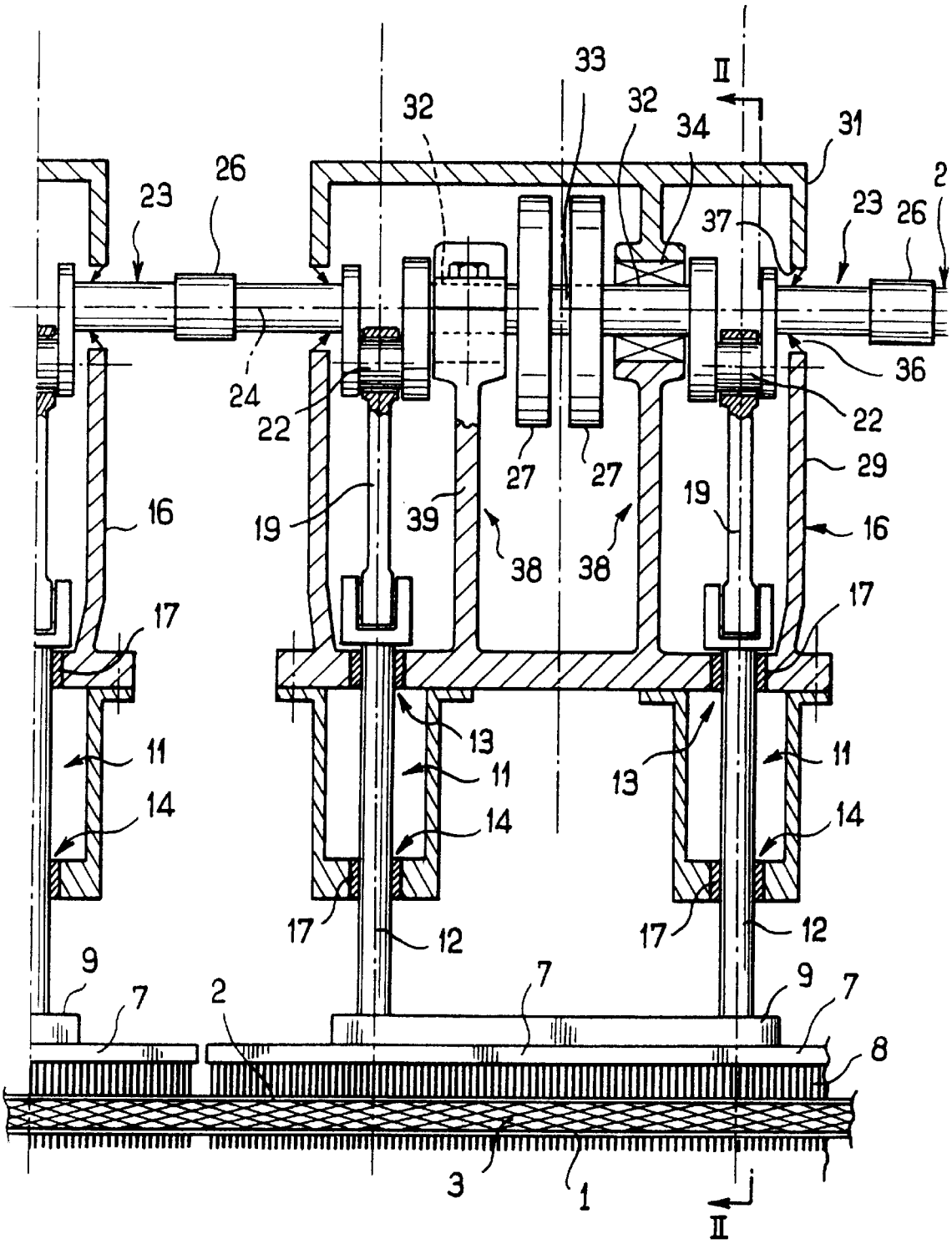
FIG. 1 is a diagrammatic partial cross-sectional front view of a needling machine according to the invention, the right hand half of the figure corresponding to a variant.
Figure 2:
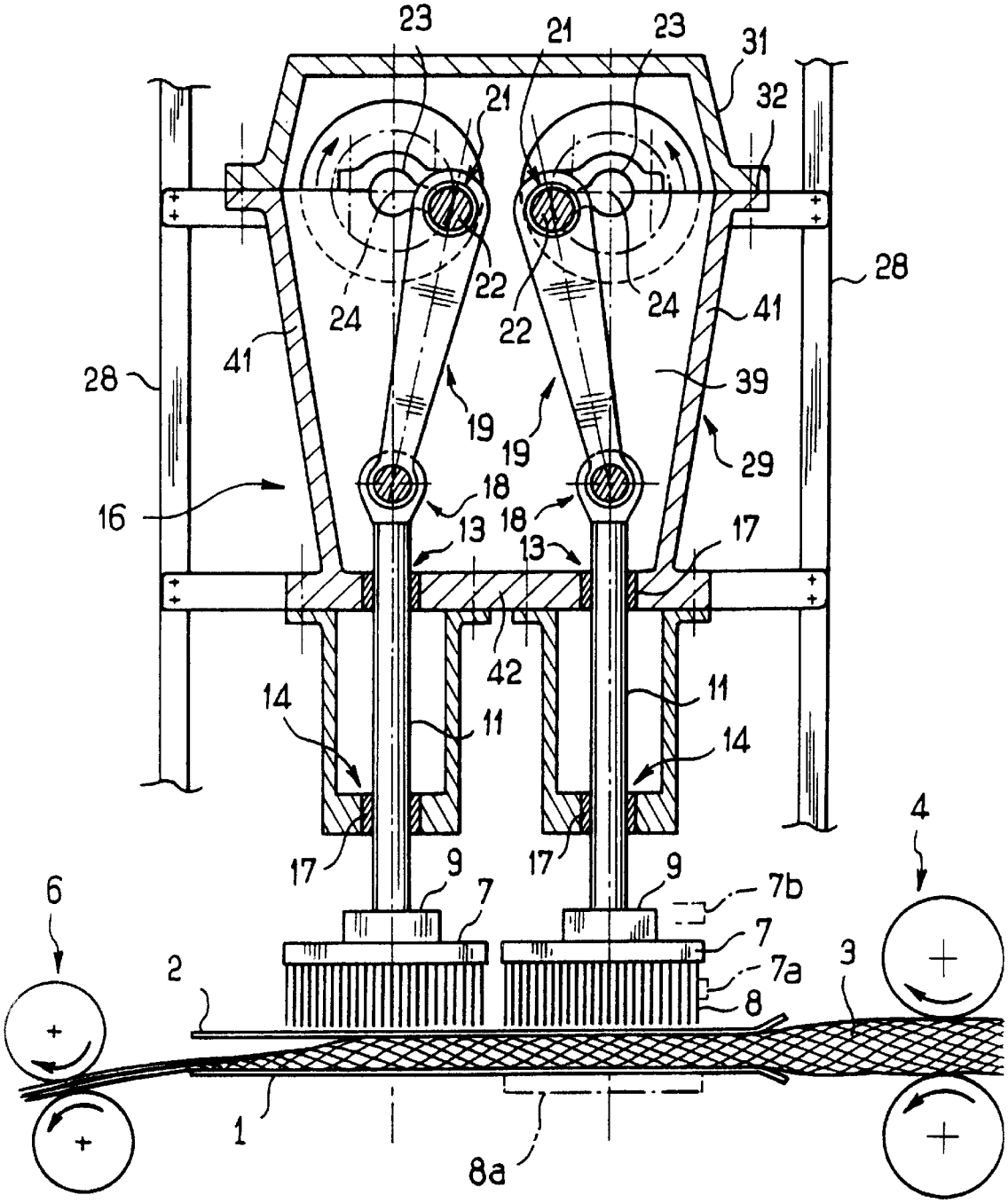
FIG. 2 is a view along II—II of FIG. 1.

The needling machine shown in FIGS. 1 and 2 comprises a generally horizontal perforated table 2, also called a "stripper", placed in an approximately parallel manner a certain distance above the table 1. The table 1 and the stripper 2 defining between them a path in a substantially horizontal plane for a fibre fleece 3. The stripper 2 comprises perforations aligned with those of the table 1. At the entrance to the path are placed insertion means 4 (FIG. 2) represented in the form of a pair of drive rollers between which the fleece 3 passes. At the exit of the path, the fleece 3, which has been consolidated and compacted by needling, is driven by extractor means 6 which are also represented by two drive rollers between which the fleece passes.

The stripper 2 is placed between the path of the fleece 3 and a series of needle boards 7. The needle boards 7 are disposed in two rows which succeed one another in the direction of motion of the fleece 3 (FIG. 2). In each row, the needle boards 7 are aligned with the width of the path of the fleece 3 (FIG. 1).

Each board 7 carries, on the stripper 2 side, a large number of needles 8 oriented perpendicularly with respect to the plane of the path of the fleece 3, with their points directed towards the fleece 3. Each needle is positioned opposite a perforation of the stripper 2 and a corresponding perforation in the table 1. Each needle board 7 is fixed, on the side opposite to the needles 8, to a support 9 which itself fixed to the ends of two rods 11 each mounted such that it slides along an axis 12 parallel to the needles 8 and perpendicular to the plane of the path of the fleece 3. The rods 11 associated with the boards of a same row are situated in a same plane perpendicular to the direction of progress of the fibres. For its sliding guidance, each sliding rod 11 is guided in two axially spaced coaxial slide bearings 13 and 14. The bearings 13 and 14 are rendered integral with a sealed crankcase 16 which will be described later. The bearings 13 and 14 comprise, for example, anti-friction rings 17 for the contact with the rod 11. The bearings 14 are followed in the direction of the support 9, by means, which are not shown, ensuring the sealing of the crankcase around each rod 11.

Each mobile mechanism constituted by the association of two sliding rods 11, the support 9 and the board 7 is driven, in service, with an alternating reciprocating motion in the direction 12 between a position 7*a* (FIG. 2) in which the ends of the needles, in this case denoted by 8*a*, traverses the stripper 2, the fleece 3 and the table 1 and a withdrawn position 7*b* in which the needles 8 are totally withdrawn at least from the table 1 and the fleece 3 and possibly from the stripper 2.

In order to impart this reciprocating motion to the mobile mechanism, the rod 11 is articulated by an articulation 18 with one end of a connecting rod 19 whose other end is connected by an articulation 21 to an eccentric 22 which is part of a crankshaft 23 driven in rotation by driving means which are not shown.

As shown in FIG. 1 there is one crankshaft 23 for each support 9. The crankshafts 23 associated with the supports 9 of the same row are coaxial and coupled in rotation about their common axis 24 by coupling devices 26. The devices 26 are of a known type capable of transmitting a strong rotational torque, substantially without angular play about the axis 24, while still accepting that the crankshafts 23, instead of being strictly coaxial, form a slight angle with respect to each other. Thus, each crankshaft 23 can work in flexion independently from the two crankshafts 23 with which is coupled by the coupling devices 26.

At one of the ends of each row of needle boards, the corresponding crankshaft 23 is coupled at least indirectly to a drive motor (not shown), and at the other end of the row, the corresponding crankshaft 23 has a free end.

There are therefore two rows of crankshafts 23, one for each row of needle boards, as illustrated in FIG. 2.

Simultaneous observation of FIGS. 1 and 2 shows that the machine comprises as many crankcases 16 as there are needle boards 7 in one of the rows. Each crankcase 16 supports in rotation two crankshafts 23 whose axes 24 are parallel and which are associated with two needle boards 7 located side by side and each one belonging to one of the rows. Each crankshaft 23 (FIG. 1) carries inertia equilibration means for stabilizing the rotational motion and possibly having a counterweight for counterbalancing the equivalent off-centred mass which is in rotation about the axis 24 of each crankshaft. The equilibration means 27 are of known type.

The crankcases 16 are fixed to a frame 28 of the needling machine, shown diagrammatically and partially in FIG. 2 and also able to support, in a fixed or adjustable manner, the table 1, the stripper 2 and the insertion 4 and extraction 6 devices. Each crankcase 16 is composed of two partial crankcases 29 and 31 forming body and cover respectively. The partial crankcases 29 and 31 are fixed to each other in a jointing plane 32 containing the geometric axes 24 of the two crankshafts 23.

The slide guide 13 and 14 for the sliding rods 11 are supported by the body 29. The cover 31 closes the body 29 on the side opDosite the sliding rods 11. Each crankshaft 23 comprises two cylindrical bearing surfaces 32 each one situated between the respective one of the eccentrics 22 and a central zone 33 on which are mounted the equilibration means 27. Each cylindrical bearing surface 33 cooperates with a respective roller bearing 34 supported by the crankcase 16. Each eccentric is situated axially between one of the bearings 34 on the side nearest the inside of the crankcase 16 and a sealing device 36 which ensures sealing between the crankshaft 23 and an orifice 37 in the peripheral wall of the crankcase 16, through which the crankshaft 23 extends towards the outside of the crankcase 16, as far as the adjacent coupling device 26. Each orifice 37 is jointly defined by the two partial crankcases 29 and 31, each of which comprises a corresponding half-bore. The orifices 37 are not provided with bearings. The crankcase 16 thus encloses, in a sealed manner, for each of the two associated crankshafts 23, the two eccentrics, the two bearings, the equilibration means 27 the two connecting rods 19 and the two articulations 18. The assembly is lubricated with oil retained inside the crankcase because of the sealing of the latter.

The crankcase 16 comprises support means 38 in order to support the bearings 34. In the example shown in the left-hand side of the crankcase 16 shown in FIG. 1, which corresponds to the example shown in FIG. 2, the support means 38 comprise, for each pair of coplanar bearings 34, a partition 39 formed in one piece with the body 29 of the crankcase 16. The partition 39 is connected to the front and rear walls 41 of the body 29 and to the bottom wall 42 of the latter, thus forming a rigidifying brace between these walls 41 and 42.

Figure 3:
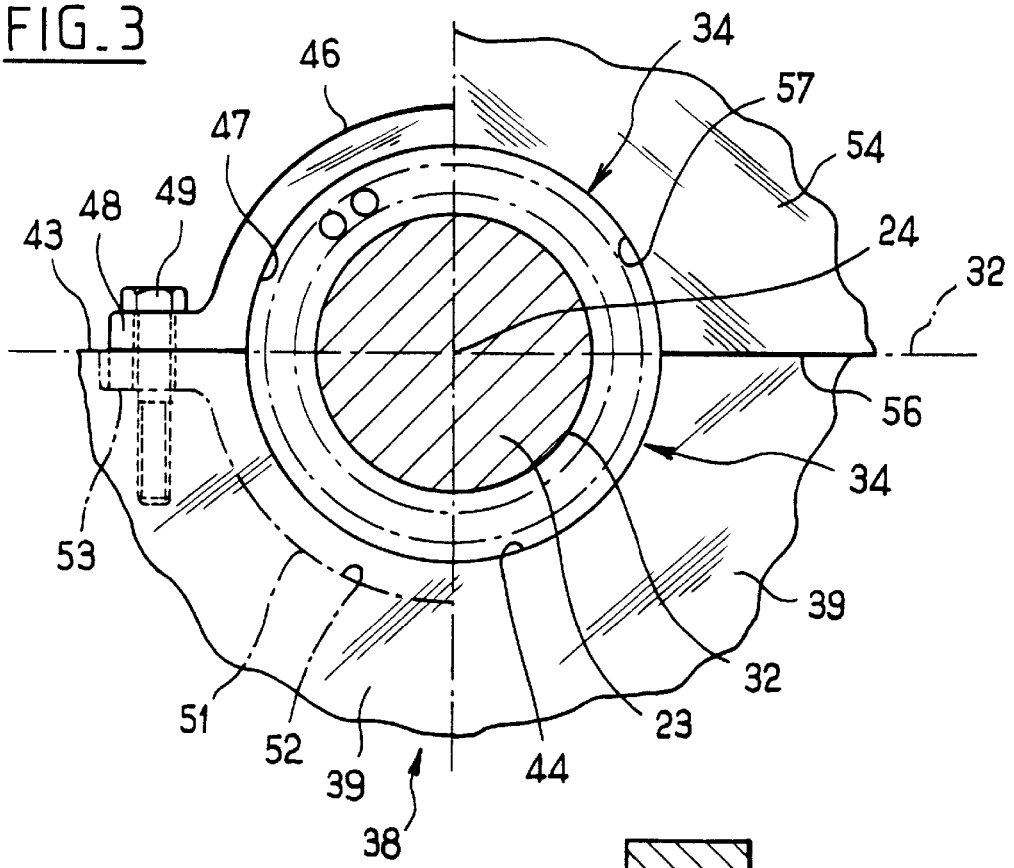
FIG. 3 is a detail view of a bearing, showing two variants simultaneously.

As shown in more detail in FIG. 3, the wall 39 comprises in its free edge 43 located in the jointing plane 32, for each of the two coplanar bearings 34, a semi-circular recess 44 whose diameter corresponds to the outer diameter of the bearing 34. According to a first embodiment shown in the left-hand half of FIG. 3, the bearing 34 is retained in the recess 44 by a cap 46 having a semi-circular internal face 47 of the same diameter and which is applied over the rest of the periphery of the bearing 34. The cap 46 is fixed by two opposite lugs 48 against the free edge 43 of the partition 39 by means of screws 49.

In a variant embodiment shown in dotted and dashed line in the left-hand part of FIG. 3, the recess 44, instead of being borne by the partition 39 can be borne by a cradle 51 fitting into a larger recess 52 formed in the free edge 43 of the partition 39. The cradle 51 comprises two opposite lugs 53 (only one of which can be seen in FIG. 3). Each screw 49 traverses a lug 48 of the cap 46 and a corresponding lug 53 of the cradle 51, and tightens these two lugs stacked against the upper recessed edge of the partition 39.

According to the third embodiment shown in the right-hand part of FIGS. 1 and 3, and which will be described only where it differs from the first embodiment, there is a second partition 54 which belongs to the cover 31 of the crankcase 16. A free edge 56 of the partition 54 is situated in the jointing plane 32 such that it is adjacent to the free edge 43 of the partition 39 when the two partial crankcases 29, 31 are assembled with each other.

The edge 56 of the partition 54 has for each of the two coplanar bearings 34 a semi-circular recess 57 of the same diameter as the recess 44 of the partition 39. When the two partial crankcases 29, 31 are assembled with each other, the recess 57 is brought into correspondence with the recess 44 in order to form a circular opening strictly positioning the bearing 34.

In the diagrammatic representations shown in FIGS. 1 and 2, the eccentrics 22 are shown with a relatively large off-centring in order to make the drawings clearer.

Figure 4:
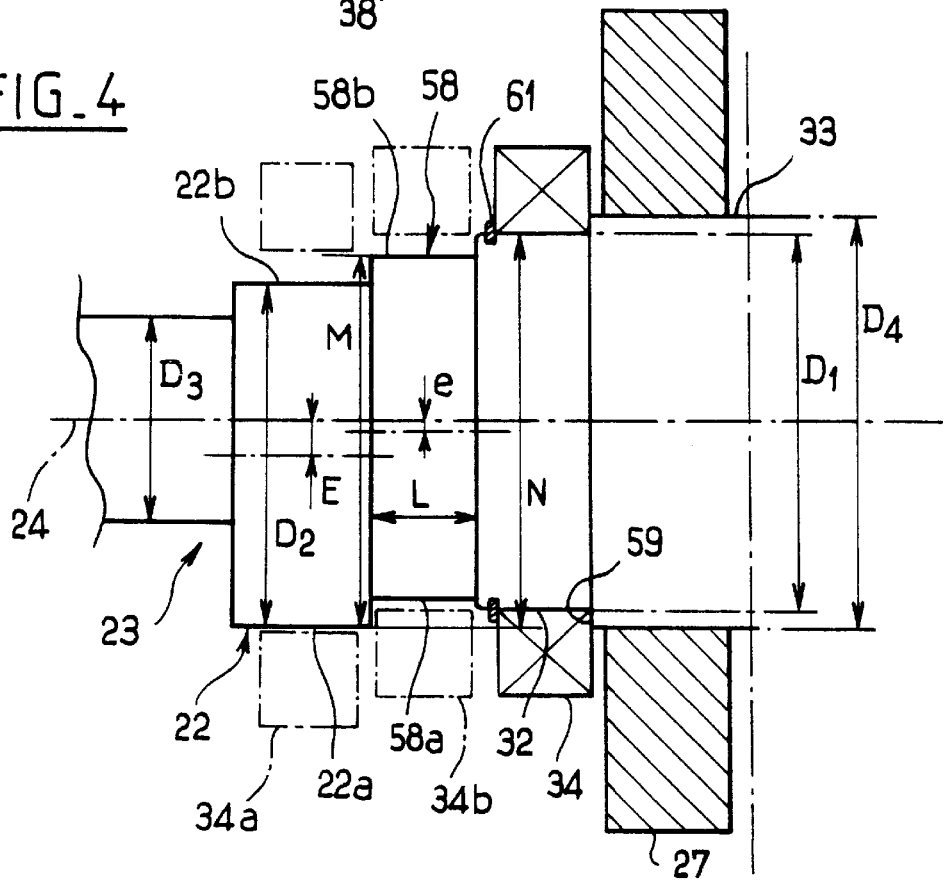
FIG. 4 is a view of a detail of the crankshaft.

In practice, as the forward and backward travel necessary for the needle boards 7 is only a few centimetes, a much lower off-centering suffices and an embodiment of the type shown in FIG. 4 is therefore advantageous. The diameter $D_1$ of the bearing surface 32 is greater than the diameter $D_2$ of the eccentric 22 so that the bearing 34 can, in a first step in its assembly, reach the position 34*a* by slipping over, starting from the corresponding end of the crankshaft 23, that is to say the end situated on the same side of the equilibrations means 27 as the bearing 34 in the process of being installed. In order to allow the bearing 34 to reach the position 34*a*, it is provided for example, as shown, that the diameter $D_3$ of the end of the crankshaft 23 is sufficiently small for the peripheral surface of the eccentric 22 to be radially projecting everywhere with respect to this end.

If the eccentric 22 were directly adjacent to the bearing surface 32, the passage of the bearing 34 from the position 34*a* to the service position on the bearing surface would necessitate the diameter $D_1$ being at least equal to the diameter $D_2$ of the eccentric 22 increased by two times the off-centring E of the eccentric 22. In order that the minimum diameter $D_1$ required for the bearing surface 32 may be less than that value, there is provided between the eccentric 22 and the bearing surface 32 a transition zone 58 which, in an angular region 58*a*, is radially recessed with respect to the region 22*a* where the periphery of the eccentric 22 is furthest from the axis 24 of the crankshaft 23. The maximum radial dimension M of the eccentric 22 and of the transition region 38 taken together is less than the diameter $D_1$ of the bearing surface 32. This allows the bearing 34 to pass from the position 34*a* to a position 34b around the transition region 58, whose axial dimension L is greater than that of the bearing 34. The transition region 58 is for example produced in the form of a cylinder having, with respect to the axis 24, an off-centering (e) less than the off-centering "E" of the eccentric 22, The off-centering "e" and "E" are oriented in the same radial direction from the axis 24. The periphery of the transition region 58 is everywhere radially recessed with respect to the bearing surface 32, such that the bearing 34 can without difficulty be fitted over the bearing surface 32 starting from the position 34*b*. In order to avoid the useless creation of regions of weakness on the crankshaft 23, the transition region 58 has a diameter which is as large as possible. The result of this is that the transition region 58 has an angular region 58*b* which radially protrudes with respect to the region 22*b* where the periphery of the eccentric 22 is closest to the axis 24 of the crankshaft.

The central zone 33 of the crankshaft 23 has a diameter $D_4$, greater than the maximum radial dimension N of the eccentric 22 and of the bearing surface 32 considered together, which allows, before the fitting of the bearing 34, the fitting without difficulty of the equilibration means 27 starting from the end of the crankshaft 23 even if, as shown, the axial dimension of the equilibration means 27 is greater than the axial dimension L of the transition region 58. The bearing 34 is retained axially between a shoulder 59, separating the bearing surface 32 and the central zone 33, and an elastic stop ring 61.

Figure 5:
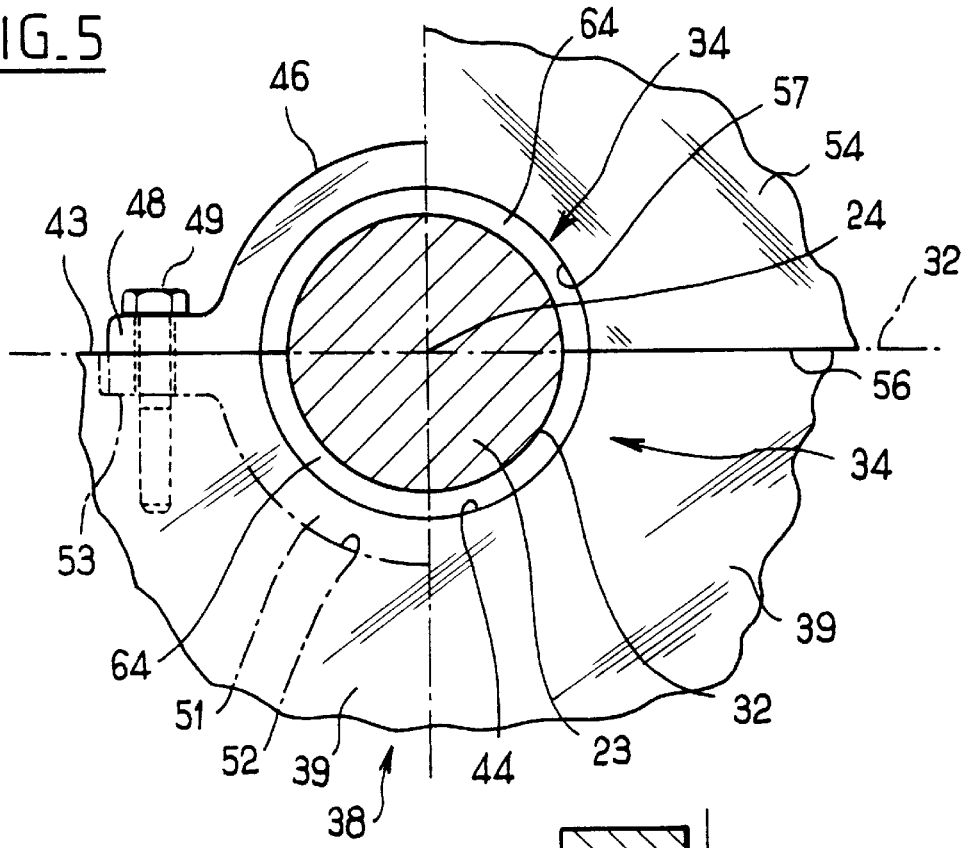
FIGS. 5 and 6 are views similar to FIGS. 3 and 4 respectively, but relating to another family of variants.

In the example shown in FIGS. 5 and 6, which will be described only where it differs with respect to that shown in FIGS. 3 and 4, the roller bearing 34 is replaced by a plain bearing 34 comprising two semi-cylindrical bushes 64 which can be fixed such that one of them is in the recess 44 of the wall 39 or of the cradle 91 and the other is in the recess 57 of the cap 46 or of the wall 54. The assembly resembles that of the connecting rod bearing bushes of a thermal engine with cylinders and pistons for the connection between the connecting rods and the crankshaft of the engine. In particular, the fitting of the bearing does not necessitate any fitting over from the ends of the crankshaft. Thus, the bearing surface 32 can, as shown, be radially recessed with respect to the other regions of the crankshaft, situated axially on both sides of the bearing surface 32, without this resulting in an impossibility of fitting. Axial stops, which are not shown, can ensure the axial positioning of the crankshaft 23, but this is not essential since in theory the crankshaft is not subjected to any axial load. As in the preceding example, the diameter $D_4$ of the central region 33 of the crankshaft 23 is at least equal to the maximum radial dimension N which the equilibration device 27 must clear by slipping over starting from the end of the shaft.

The invention is of course not limited to the examples described and shown.

In the examples where there is only one single internal partition such as 39 for supporting each bearing, this partition could be integral with the cover of the crankcase instead of being integral with the body of the crankcase as has been described.

In order to allow the fitting of the bearings and of the equilibration means without having recourse to the advantageous solution described with reference to FIG. 4, it would be possible to produce the crankshaft in the form of two half-crankshafts attached to one another in the region of the central zone 33 after the fitting of the bearings and of the equilibration means starting from the central zone 33, which would havea diameter at most equal to that of the bearing surface 32.

Figure 6:
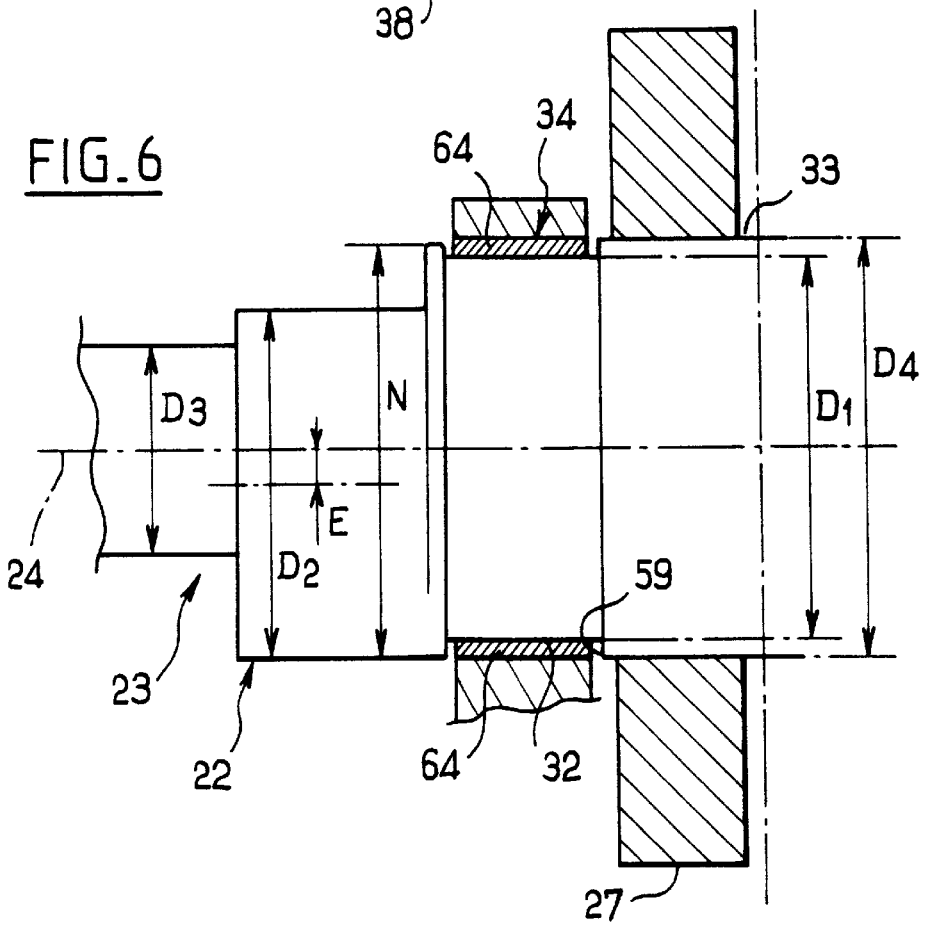

It would also be possible, starting from an embodiment according to FIG. 4 or FIG. 6, to produce each equilibration device 57 in two parts attached to one another in a substantially axial jointing plane, in order to avoid the necessity of assembly by slipping over.

In this case, the diameter of the central region 33 of the crankshaft can be chosen freely with respect to the other diameters of the crankshaft.

We claim:

1. A needling machine actuation device comprising a crankcase having two opposed end walls and in which at least one crankshaft has an axis of rotation and is supported in rotation by at least two bearings, the crankshaft comprising two eccentrics each of which is articulated with a first end of a respective connecting rod having a second end adapted to be at least indirectly connected to a needle board, equilibration means furthermore being attached to the crankshaft, wherein the two bearings are supported inside the crankcase at positions situated axially between the two eccentrics, the equilibration means are situated axially between the two bearings, and each eccentric is situated between a respective one of the two bearings and a respective one of said end walls of the crankcase, the crankcase being provided with bearing supporting means inside said crankcase between said end walls.

2. The device according to claim 1, wherein at least one of said end walls of the crankcase has a respective orifice therethrough, a sealing device is fitted in said orifice, and each eccentric is situated axially between the respective one of the bearings and said sealing device, said crankshaft extending through said sealing device and orifice without being supported therein.

3. The device according to claim 1, wherein the crankshaft comprises for each bearing a bearing surface having a diameter greater than the diameter of the closest eccentric, but less than the diameter of the eccentric increased by twice its off-centering, each said eccentric has a periphery with a first region and the crankshaft comprises between each bearing surface and the closest eccentric a transition zone which is radially recessed with respect to said first region of the periphery of the eccentric where the distance between the periphery of the eccentric and the axis of rotation of the crankshaft is the greatest.

4. The device according to claim 3, wherein the transition zone is radially protruding with respect to a second region of the periphery of the eccentric where the distance between the periphery of the eccentric and the axis of rotation of the crankshaft is smallest.

5. The device according to claim 3, wherein the transition zone is off-centered with respect to the axis of rotation of the crankshaft.

6. The device according to claim 3, wherein said crankshaft has a central zone located axially between said bearings, the equilibration means are fitted over said central zone, and a diameter of the central zone is at least equal to the maximum radial dimension of the eccentric and of the bearing surface considered together.

7. The device according to claim 6, wherein the equilibration means have a greater axial dimension than that of the transition zone.

8. The device according to claim 1, wherein the bearings are of a plain type, each comprising two semi-cylindrical bushes.

9. The device according to claim 1, wherein the crankcase comprises two partial crankcases attached to each other and one of the partial crankcases comprises as said bearing-supporting means, internal partitions having free edges which have recesses forming bearing housings, the bearings being fitted in these housings and in bearing caps attached to the internal partitions opposite the recesses.

10. The device according to claim 1, wherein the crankcase comprises two partial crankcases attached to each other and comprising as said bearing supporting means, at least one pair of internal partitions defining between them at least one bearing housing.

11. The device according to claim 1, wherein the crankcase comprises two partial crankcases attached to each other, one of the partial crankcases comprises as said bearing-supporting means, internal partitions each having a free edge, and a bearing cradle and a bearing cap which are both attached to said free edge of each internal partition.

12. The device according to claim 1, wherein said crankcase has outer walls, and said bearing-supporting means comprise internal partitions of the crankcase which form braces between said outer walls of the crankcase.

13. The device according to claim 1, comprising for each said connecting rod a slide rod articulated with said second end of the connecting rod and slidingly mounted in slide guides supported by the crankcase, each slide rod being intended to connect one of the connecting rods with the needle board.

14. A needling machine for mechanically consolidating a fibre fleece, comprising:

means for causing the fibre fleece to move in a plane of motion, a needle board support, actuation means for mechanically actuating the needle board support in a reciprocating manner in a transverse direction with respect to the plane of motion, wherein the actuation means comprise at least one actuation device comprising a crankcase having two opposed end walls and in which at least one crankshaft is supported in rotation by at least two bearings, the crankshaft comprising two eccentrics each of which is articulated with a first end of a respective connecting rod having a second end adapted to be at least indirectly connected to a needle board, equilibration means furthermore being attached to the crankshaft, wherein the two bearings are supported inside the crankcase at positions situated axially between the two eccentrics, the equilibration means are situated axially between the two bearings, and each eccentric is situated between a respective one of the two bearings and a respective one of said end walls of the crankcase, the crankcase being provided with bearing supporting means inside said crankcase between said end walls.

15. The needling machine according to claim 14, wherein the actuation means comprise several actuation devices aligned in the direction of the width of the fleece, and whose crankshafts are generally coaxial with each other and are coupled between them by couplings accepting a slight angular deflection between the successive crankshafts.

16. A needling machine actuation device comprising a crankcase having two opposed end walls and in which at least one crankshaft is supported in rotation by at least two bearings, the crankshaft comprising two eccentrics each of which is articulated with a first end of a respective connecting rod having a second end adapted to be at least indirectly connected to a needle board, equilibration means furthermore being attached to the crankshaft, wherein the two bearings are supported inside the crankcase at positions situated axially between the two eccentrics, the equilibration means are situated axially between the two bearings, and each eccentric is situated between a respective one of the two bearings and a respective one of said end walls of the crankcase, and wherein the crankshaft comprises for each bearing, a bearing surface having a diameter greater than the diameter of the closest eccentric, but less than the diameter of the eccentric increased by twice its off-centering, and the crankshaft comprises between each bearing surface and the closest eccentric a transition zone which is radially recessed with respect to a first region of the periphery of the eccentric where the distance between the periphery of the eccentric and the axis of rotation of the crankshaft is the greatest.

17. The device according to claim 16, wherein the transition zone is radially protruding with respect to a second region of the periphery of the eccentric where the distance between the periphery of the eccentric and the axis of rotation of the crankshaft is smallest.

18. The device according to claim 16, wherein the transition zone is off-centered with respect to the axis of rotation of the crankshaft.

19. The device according to claim 16, wherein said crankshaft has a central zone axially between said bearings, the equilibration means are fitted over said central zone, and the diameter of the central zone is at least equal to the maximum radial dimension of the eccentric and of the bearing surface considered together.

20. The device according to claim 19, wherein the equilibration means have a greater axial dimension than that of the transition zone.

21. The device according to claim 16, wherein the bearings are of the plain type each comprising two semi-cylindrical bushes.

22. The device according to claim 16, wherein the crankcase comprises two partial crankcases attached to each other and one of the partial crankcases comprises as said bearing-supporting means, internal partitions having free edges which have recesses forming bearing housings, the bearings being fitted in these housings and in bearing caps attached to the internal partitions opposite the recesses.

23. The device according to claim 16, wherein the crankcase comprises two partial crankcases attached to each other and comprising, as said bearing-supporting means, at least one pair of internal partitions defining between them at least one bearing housing.

24. The device according to claim 16, wherein the crankcase comprises two partial crankcases attached to each other and comprising, as said bearing-supporting means, internal partitions, each having at least one free edge and a bearing cradle and a bearing cap which are both attached to one of said at least one free edges of a respective one of said internal partitions.

25. The device according to claim 16, wherein said crankcase further includes outer walls, said bearing-supporting means comprise internal partitions of the crankcase which form braces between said outer walls of the crankcase.

26. The device according to claim 16, further including slide guides supported by the crankcase, and, for each connecting rod a slide rod articulated with said second end of the connecting rod and slidingly mounted in said slide guides, each slide rod being intended to connect one of the connecting rods with the needle board.

27. The device according to claim 16, wherein at least one of said end walls of the crankcase has a respective orifice therethrough, a sealing device is fitted in said orifice, and each eccentric is situated axially between the respective one of the bearings and said sealing device, said crankshaft extending through said sealing device and orifice without being supported therein.

28. A needling machine for mechanically consolidating a fibre fleece, comprising:

means for causing the fibre fleece to move in a plane of motion, a needle board support, actuation means for mechanically actuating the needle board support in a reciprocating manner in a transverse direction with respect to the plane of motion, wherein the actuation means comprise at least one actuation device comprising a crankcase having two opposed end walls and in which at least one crankshaft is supported in rotation by at least two bearings, the crankshaft comprising two eccentrics each of which is articulated with a first end of a respective connecting rod having a second end adapted to be at least indirectly connected to a needle board, equilibration means furthermore being attached to the crankshaft, wherein the two bearings are supported inside the crankcase at positions situated axially between the two eccentrics, the equilibration means are situated axially between the two bearings, and each eccentric is situated between a respective one of the two bearings and a respective one of said end walls of the crankcase, and wherein the crankshaft comprises for each bearing, a bearing surface having a diameter greater than the diameter of the closest eccentric, but less than the diameter of the eccentric increased by twice its off-centering, and the crankshaft comprises between each bearing surface and the closest eccentric a transition zone which is radially recessed with respect to a first region of the periphery of the eccentric where the distance between the periphery of the eccentric and the axis of rotation of the crankshaft is the greatest.

29. The needling machine according to claim 28, wherein the actuation means comprise several actuation devices aligned in the direction of the width of the fleece, and whose crankshafts are generally coaxial with each other and are coupled between them by couplings accepting a slight angular deflection between the successive crankshafts.

30. A needling machine actuation device comprising a crankcase having two opposed end walls and in which at least one crankshaft has an axis of rotation and is supported in rotation by at least two bearings, the crankshaft comprising two eccentrics each of which is articulated with a first end of a respective connecting rod having a second end adapted to be at least indirectly connected to a needle board, equilibration means furthermore being attached to the crankshaft, wherein the two bearings are supported inside the crankcase at positions situated axially between the two eccentrics, the equilibration means are situated axially between the two bearings, and each eccentric is situated between a respective one of the two bearings and a respective one of said end walls of the crankcase, the crankcase being provided with bearing supporting means located inside said crankcase and between said end walls, each said bearing being supported by a corresponding one of said bearing supporting means.

* * * * *